US010030314B1

(12) United States Patent
Zhang et al.

(10) Patent No.: US 10,030,314 B1
(45) Date of Patent: Jul. 24, 2018

(54) PLASMA OXIDATION METHOD FOR MAKING AIR-CONTAINING OXIDE COATING ON POWERTRAIN COMPONENTS

(71) Applicants: Jingzeng Zhang, Windsor (CA); Yining Nie, New York, NY (US); Xueyuan Nie, Windsor (CA)

(72) Inventors: Jingzeng Zhang, Windsor (CA); Yining Nie, New York, NY (US); Xueyuan Nie, Windsor (CA)

( * ) Notice: Subject to any disclaimer, the term of this patent is extended or adjusted under 35 U.S.C. 154(b) by 0 days.

(21) Appl. No.: 15/470,520

(22) Filed: Mar. 27, 2017

(51) Int. Cl.

| | |
|---|---|
| ***C25D 11/02*** | (2006.01) |
| ***C25D 11/04*** | (2006.01) |
| ***C25D 11/26*** | (2006.01) |
| ***C25D 11/30*** | (2006.01) |
| ***C25D 11/06*** | (2006.01) |
| ***C25D 21/00*** | (2006.01) |

(52) U.S. Cl.
CPC ..... *C25D 11/026* (2013.01); *C25D 11/04* (2013.01); *C25D 11/06* (2013.01); *C25D 11/26* (2013.01); *C25D 11/30* (2013.01); *C25D 21/00* (2013.01)

(58) Field of Classification Search
CPC ..... C25D 11/026
See application file for complete search history.

(56) References Cited

U.S. PATENT DOCUMENTS

2010/0032301 A1* 2/2010 Hiratsuka ..... C25D 11/06 205/50
2013/0221816 A1* 8/2013 Liou ..... H05K 5/02 312/223.1

FOREIGN PATENT DOCUMENTS

CA 2474367 A1 * 1/2006 ..... C25D 11/00

* cited by examiner

*Primary Examiner* — Brian W Cohen

(57) ABSTRACT

This invention involves a plasma oxidation method for making an oxide coating containing air pockets. The encapsulated air, which has minimal thermal conductivity and capacity, allows the coating to adapt quickly to changes in the surrounding temperature. The thermal diffusivity and conductivity of the coated metal can be tailored to provide various thermal functions for internal combustion engine parts.

10 Claims, 4 Drawing Sheets

PLASMA OXIDATION METHOD FOR MAKING AIR-CONTAINING OXIDE COATING ON POWERTRAIN COMPONENTS

FIELD OF THE INVENTION

The invention is related to a coating technology that is designed to make an air-containing oxide coating for internal combustion engine components with improved thermal management.

BACKGROUND OF THE INVENTION

There is a great need to increase the fuel efficiency of internal combustion engines (ICEs). In the past, a conventional thermal barrier coating (TBC) usually prepared by thermal spray technology was used in an attempt to increase ICE fuel efficiency through the reduction of heat transfer loss. However, while TBC increased the mechanical durability of coated components at high combustion temperatures, it did not obviously improve the fuel efficiency of ICEs This is because TBC can retain constantly high surface temperatures, likely causing a pre-ignition or knocking problem. In order to avoid these problems, the fuel ignition time must be retarded, resulting in lower combustion efficiency.

It is also difficult for thermal spray coating technology to be deposited on small channels and irregular internal surfaces. Enamel and sol-gel coating technologies can be used to deposit TBC, but a series of post-heat treatments may be required. A hard anodizing process can also create TBC, but the resulting oxide coating has an amorphous structure with high internal residual tensile stresses causing many surface cracks; these cracks may lead the coating to have a peeling problem under cyclic heating and cooling ICE conditions. Furthermore, it is difficult for a hard anodizing process to make a coating thicker than 70-80 microns.

Plasma electrolytic oxidation (PEO) or micro-arc oxidation technology [Nie and Matthews et al., Surface & Coatings Technology, 1999] can produce an oxide coating as well. However, the current trend in oxidation processes is to make the coating dense with a limited porosity, and it is challenging to coat a local surface area of an ICE component since a complicated masking technique is needed on surfaces where no coating is required.

Most importantly, a coating prepared by use of the conventional thermal spray, anodizing process, PEO or micro-arc oxidation coating process, does not have the flexibility to meet the different thermal management requirements of the various ICE components. For a cylinder bore, a high thermal conductive coating surface is desired in order to cool air within the cylinder during the intake stroke; for a cylinder head, a low thermal conductive and diffusive coating surface is beneficial to reduce heat loss; and for a piston, a piston crown surface with low thermal diffusivity and low thermal capacity would be needed to decrease heat rejection loss and swiftly adapt to temperature oscillation between combustion and intake strokes. The coatings currently in use have not been and may not be able to meet those different thermal property requirements at the same time.

The invention hereby relates to an innovative plasma oxidation method for making an air-containing oxide coating which provides the thermal properties needed for the different functions of ICE components. The said coating method is to tailor the volume percentage of air pockets in the oxide coating, thus achieving an optimized thermal resistance, thermal inertia and heat transferring property for various engine components.

SUMMARY OF THE INVENTION

This invention is a coating method which manipulates the thermal properties of light metals through the deposition of an air-containing oxide coating on the surface of the metals. The invention produces an oxide coating containing encapsulated air. The oxide ceramic portion within the coating herein has a low thermal conductivity and diffusivity, and the encapsulated air within the coating has a very low thermal capacity.

The said coating may have other terminology, including but not limited to, a ceramic oxide coating with air pockets, an air-containing ceramic oxide coating, a ceramic coating containing encapsulated air, a ceramic coating with encapsulated air, a ceramic coating containing air in pores or pockets, and a ceramic coating with pores for air storage.

In the invention, the encapsulated air in the oxide coating has a thermal conductivity and capacity much lower than the ceramic portion of the coating. As a result, the ceramic oxide containing a certain volume percentage of air adapts quickly to changes in thermal temperature. Consequently, during the ICE intake stroke after completion of a combustion cycle, the temperature on the coated component surface will drop back down to ambient temperature without heating in-cylinder air.

In the invention, the air-containing oxide ceramic coating can be made to have very low thermal conductivity and diffusivity, which can decrease the temperature of the base material underneath the coating. Therefore, the coated metallic material can withstand even greater combustion temperature and pressure.

In the invention, the air-containing oxide ceramic coating is corrosion-resistant, and the coated metallic base material can have an improved general and galvanic corrosion resistance against alternative fuels, water injection and wet environments.

In the invention, the ceramic oxide material in the said coating consists of at least one or more of the following oxides: aluminium oxide, aluminium-silicon oxide, aluminium-phosphorus oxide, aluminium-silicon-phosphorus oxide, aluminium-molybdenum oxide, aluminium-tungsten oxide, titanium oxide, titanium-aluminium oxide, titanium-silicon oxide, titanium-phosphorus oxide, titanium-aluminium-silicon oxide, titanium-aluminium-phosphorus oxide, titanium-aluminium-silicon-phosphorus oxide, titanium-molybdenum oxide, titanium-tungsten oxide, magnesium oxide, magnesium-aluminium oxide, magnesium-silicon oxide, magnesium-phosphorus oxide, magnesium-aluminium-silicon oxide, magnesium-aluminium-silicon-phosphorus oxide, magnesium-molybdenum oxide, and magnesium-tungsten oxide.

In the invention, the said coating is preferably made using, with modification, an electrolytic jet plasma oxidation process, in which an electrolyte is directly applied onto a local, irregular or inner surface for localized coating deposition [Zhang and Nie et al., Canadian Patent: CA2556869]. Modifications to the coating process parameters include using higher than standard electrical current densities as well as chemical additives to increase the electrical conductivity of the oxide coating. The innovative process modifications promote formation of air pockets in the ceramic oxide coating.

In the invention, the said coating can be deposited on cylinder bores, cylinder heads, intake and exhaust ports, pistons, valves, superchargers, turbochargers, or other ICE components made of aluminium, titanium or magnesium or their alloys.

DETAILED DESCRIPTION OF THE INVENTION

Figure 1:
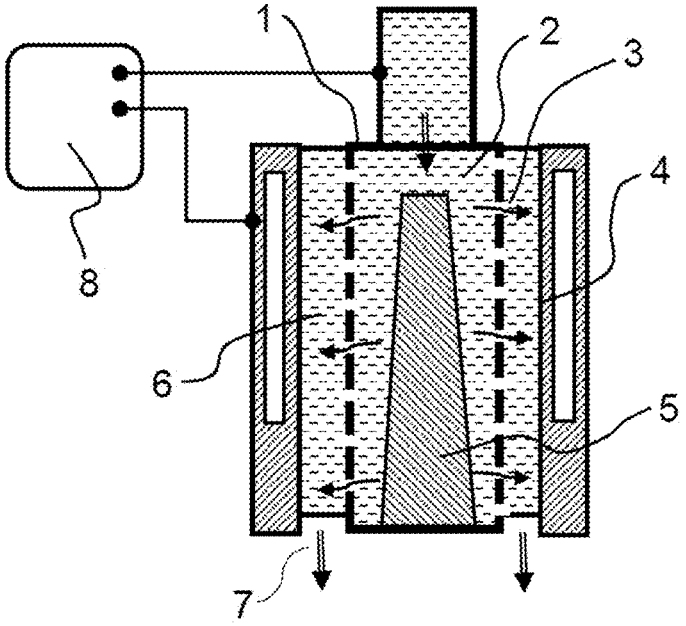
FIG. 1 is a schematic illustration of a plasma oxidation method for making an air-containing oxide coating on a cylinder bore surface in accordance with embodiments.

Referring to the schematic illustration in FIG. 1, a metallic spraying head 1 brings an electrolyte 2, through nozzles 3, onto a cylinder bore surface 4; the electrolyte flow pattern can be adjusted by an insert 5 so that the electrolyte 2 fills the gap 6 between the nozzles 3 and the cylinder bore 4, before draining out 7; and when a power supply 8 applies high electrical current and voltage between the spraying head 1 and the cylinder 4, plasma discharges are generated on the surface of cylinder bore 4 to form an oxide coating.

Figure 2:
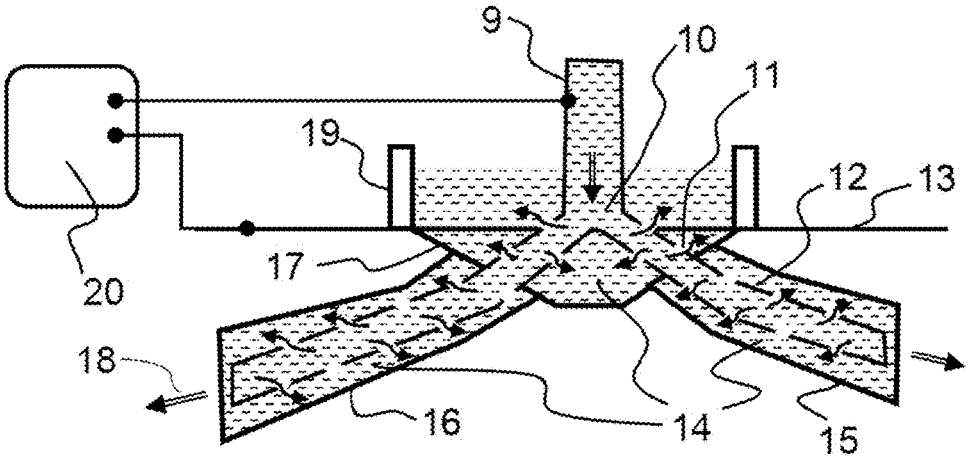
FIG. 2 is a schematic illustration of a plasma oxidation method for making an air-containing oxide coating on a cylinder head combustion chamber dome, intake and exhaust port in accordance with embodiments.

Referring to the schematic illustration in FIG. 2, a metallic spraying head 9 brings an electrolyte 10, through nozzles 11 of branches 12, to fully fill cavity spaces 14 between the spraying head 9 and cylinder head 13 where the electrolyte 10 immerses one or more of exhaust ports 15, intake ports 16, and combustion chamber domes 17 before it is draining out 18; the coming electrolyte 10 is held by a cover 19 to prevent the electrolyte 10 from overflowing; and when a power supply 20 applies high electrical current and voltage between the spraying head 9 and the cylinder head 13, plasma discharges are generated to form oxide coatings on one or more of the exhaust ports 15, intake ports 16 and cylinder head combustion chamber domes 17, dependent on a number of the branches 12 arranged.

Figure 3:
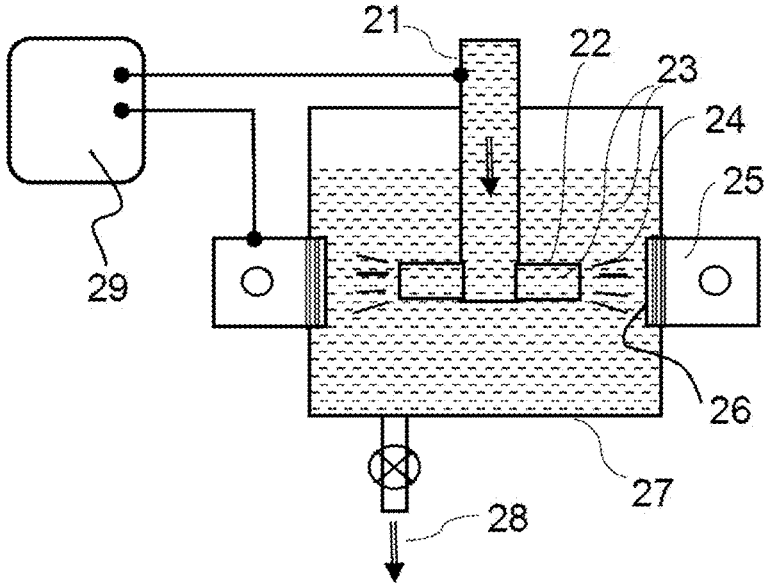
FIG. 3 is a schematic illustration of a plasma oxidation method for making an air-containing oxide coating on a piston crown surface in accordance with embodiments.

Referring to the schematic illustration in FIG. 3, a metallic spraying head 21 with nozzles 22 generates strong streams 24 of electrolyte 23 toward crowns 26 of pistons 25; the electrolyte 24 is held by container 27 and drained out 28 at a certain flow rate to keep the electrolyte level stable; and when a power supply 29 applies high electrical current and voltage between the spraying head 21 and the pistons 25, plasma discharges are generated on the surfaces 26 of pistons 25 to form oxide coatings.

Figure 4:
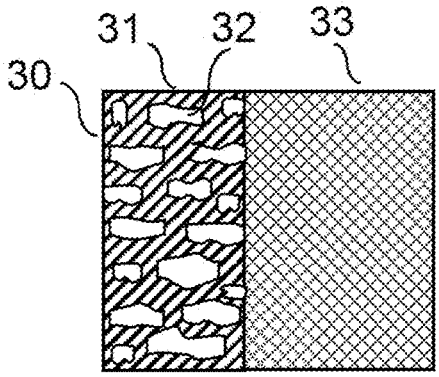
FIG. 4 is a schematic illustration of a cross-section of an oxide coating containing air pockets in accordance with embodiments.

Referring to the schematic illustration in FIG. 4, the oxide coating has a surface 30 and an oxide ceramic layer 31; within the oxide layer 31, air is encapsulated at a number of locations where disconnected air pockets 32 exist; the coating is plasma oxidized of a metallic base material 33.

Figure 5:
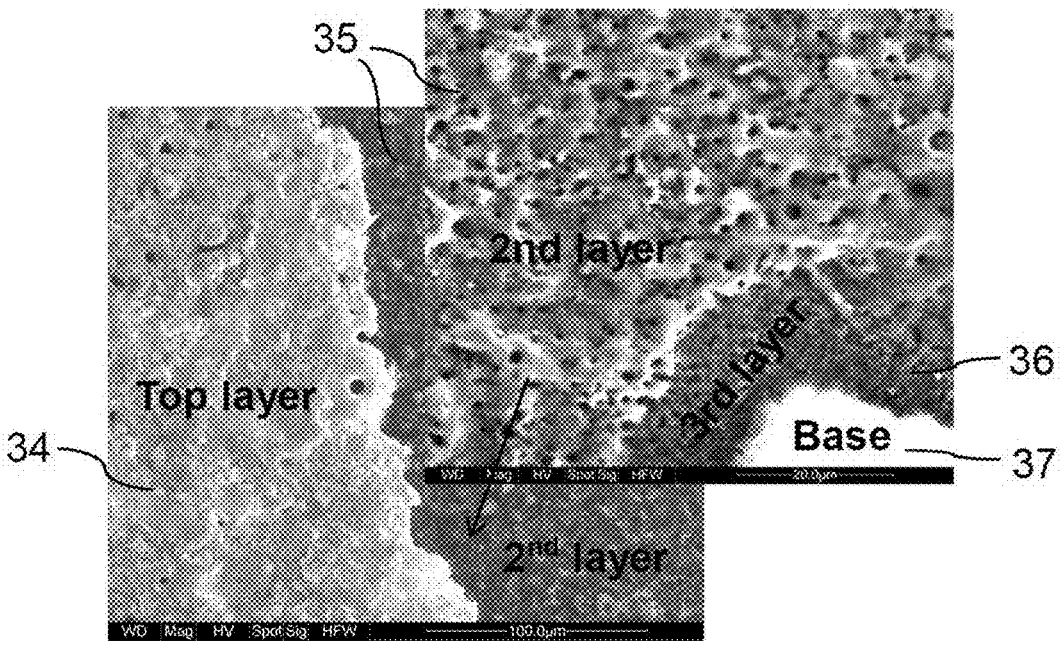
FIG. 5 is a scanning electron microscopy image of an air-containing oxide coating in accordance with embodiments.

Referring to FIG. 5, the left-side micrograph shows a low magnification scanning electron microscopy image of an oxide coating with respect to the coating's top layer 34, where most of the pores (or plasma discharging channels) are covered without opening pockets; the right-side micrograph shows an image of an underneath layer 35 (i.e., the second layer) where a large number of air pockets exist; and in the third layer 36 of the coating on a base metallic material 37, the sizes of air pockets are smaller.

Referring to FIGS. 1, 2 and 3, an electrolyte is supplied through a spraying head to a metallic surface that is to be coated. The metal is then biased with a high voltage in the range of 150V-680V by connecting it to a high voltage, high current power supply. Under the high voltage, plasma discharge is generated on the surface in contact with the electrolyte. Consequently, a plasma oxidation process is produced, depositing a ceramic oxide coating on the metallic surface. The plasma discharge also causes pores within the coating layer to form air pockets. The discharge initiation sites and discharge density and strength can be adjusted by controlling the electrical current waveform, including unipolar, bipolar or combined unipolar with bipolar pulsed currents. As a result, the volume of encapsulated air in the coating can be tailored.

Referring to FIG. 4, a high volume percentage of air pockets in the invention is generated by controlling the strengths of three types of plasma discharge: A (top air/gas glow discharge on the top of coating), B (strong micro-arc discharge initiated at the interface between the ceramic layer and the metallic base material), and C (electrolytic vapor induced glow discharge in centred areas of the ceramic layer). Although these three discharges have been described in some of the inventors' previous technical papers [Nie, et al, Surface & Coating Technology, 2010; J. Vacuum Science and Technology, 2010], those papers were written mainly from anti-wear and corrosion prevention point of view. In other words, research objectives in the papers were to find a method to depress strong B discharges which are detrimental to wear and corrosion properties. However, this invention would encourage the strong B discharge to form large air pockets within the lower part of ceramic layer and utilize A and C discharge to form small air pockets in the upper part of the ceramic layer, by appropriately using a high processing current density (i.e., 0.5-5.0 $mA/mm^2$) and using a unipolar current mode, bipolar current mode, or unipolar plus bipolar current modes.

Referring to FIG. 4, chemical substances containing at least one of molybdenum, tungsten, titanium and carbon are added to the electrolyte and can incorporate into the oxide coating, thus increasing electrical conductivity of the coating and promoting B discharge as well as A and C discharge during the coating growing process. The strong and intense discharge generates more sites for gas and vapor production, forming a high number of air pockets in the oxide layer during coating solidification and densification.

Referring to FIG. 5, an oxide coating thinner than 30 microns in coating thickness is similar to its uncoated substrate in thermal diffusivity, around 60 square millimeters per second ($mm^2/s$). A coating having 50-70 microns coating thickness can reduce thermal diffusivity by half, compared to the uncoated substrate. The 80-120 microns thick coating has a significantly lower thermal diffusivity, less than 20 $mm^2/s$.

Referring to FIG. 5, a coating and its base metal forms a hybrid material. The oxide coating itself can have a thermal conductivity of as low as 0.15 to 2.5 Walt per meter per Kelvin (W/m·K). When the coating has a coating thickness 20-30 microns deposited on an aluminium (Al) substrate, the hybrid material (i.e., coated Al) has a thermal conductivity larger than a cast iron material, 60-100 W/m·K. Thermal conductivity of the coated Al decreases substantially, to less than 10-30 W/m·K, when the coating is thicker than 50 microns. The substrate wall thickness can also greatly influence the thermal conductivity. The thinner the substrate wall, the lower the thermal conductivity of the coated component.

Referring to the illustration in FIG. 4, the coated surface has a higher thermal emissivity than the uncoated surface. The ceramic oxide portion 31 of the coating comprises at least one of the following substances: aluminium oxide, aluminium-silicon oxide, aluminium-phosphor oxide, aluminium-silicon-phosphor oxide, aluminium-molybdenum oxide, aluminium-tungsten oxide, titanium oxide, titanium-aluminium oxide, titanium-silicon oxide, titanium-phosphorus oxide, titanium-aluminium-silicon oxide, titanium-aluminium-phosphor oxide, titanium-aluminium-silicon-phosphor oxide, titanium-molybdenum oxide, titanium-tungsten oxide, magnesium oxide, magnesium-aluminium oxide, magnesium-silicon oxide, magnesium-phosphorus oxide, magnesium-aluminium-silicon oxide, magnesium-aluminium-silicon-phosphorus oxide, magnesium-molybdenum oxide, and magnesium-tungsten oxide.

Referring to the illustration in FIG. 4, the encapsulated air 32 possesses a much lower thermal conductivity and thermal capacity, compared to the ceramic portion. The volume percentage of the air can be altered by changing the plasma oxidation process parameters including electrolyte composition and concentration, electrical current density, current mode (unipolar, bipolar or combined unipolar with bipolar current) and the process ending voltage. The size of air pockets 32 is in a range of 0.1-10 microns. The metallic base material 33 comprises aluminium, titanium, magnesium or alloys or intermetallic compounds made of the chemical elements.

According to embodiments in this invention, a preferable volume percentage of the encapsulated air in the oxide coating is 10%-40%, wherein the portion of encapsulated air has a heat capacity 100-1000 times lower than the portion of ceramic material. By tailoring the volume percentage of air pockets in the oxide coating, an oxide-coated metallic material (called a hybrid material) can have a thermal diffusivity in the range of 5-50 $mm^2/s$ and a thermal conductivity of 0.15-150 W/m·K.

According to embodiments in this invention, the oxide coating thickness can be prepared to be in the range of 15-150 microns. The coating thickness for ICE piston crowns can be in the range of 20-100 microns, preferably 25-75 microns; the coating thickness for ICE cylinder bores can be in the range of 15-75 microns, preferably 20-40 microns; the coating thickness for ICE cylinder heads in combustion chamber domes, exhaust and intake ports can be in the range of 20-150 microns, preferably 30-100 microns; and the coating thickness for ICE supercharger rotors and turbocharger turbine wheels can be in the range of 20-100 microns, preferably 30-50 microns.

According to embodiments in this invention, an air-containing ceramic coating has a low thermal inertia and can change its surface temperature quickly by following the temperature fluctuation of different strokes in the combustion chamber during the ICE operation process. The little heat energy stored in the coating, due to the low heat capacity of the air-containing coating, does not cause in-cylinder air to heat up during the intake stroke. This avoids a potential pre-ignition and knocking problem. For this purpose, the air-containing coating can be applied to piston crowns, cylinder bores and combustion chamber areas of cylinder heads.

According to embodiments in this invention, an air-containing ceramic oxide coating can be made to have low thermal diffusivity and thermal conductivity for coating exhaust and intake ports to reduce heat lost to the engine coolant and avoid in-cylinder air heating, respectively.

According to embodiments of the invention, the coated metallic material with its corrosion-resistant ceramic surface can have an improved general and galvanic corrosion resistance against alternative fuels, water injection, exhaust condensate, and wet environments in an ICE engine.

According to embodiments of the invention, an air-containing ceramic coating is deposited on turbocharger, supercharger, and EGR (exhaust gas recirculation) components to protect the base materials and avoid coking problems.

According to embodiments of the invention, an air-containing ceramic coating is deposited on parts for thermal managements of battery, electrical motor cooling, electrical and air pumps and actuators.

While the invention has been described in detail in connection with only a limited number of embodiments, the invention should cover any modified variations, alternations, substitutions and equivalent arrangements which are commensurate with the spirit and scope of the invention.

The invention claimed is:

1. A coating method, comprising the steps of:

spraying an electrolyte with one or more chemical additives onto a surface of a metal, applying an electrical voltage and current to the metal, generating plasma discharges on the surface of the metal, and forming an air-containing oxide coating due to the plasma discharge on the metal, wherein a volume percentage of the air in the coating is 10%-40%.

2. The coating method according to claim 1, wherein the one or more chemical additives contain at least one of molybdenum, tungsten, cobalt, titanium or carbon which incorporate into the coating for increased electrical conductivity and promote gas and vapor discharge.

3. The coating method according to claim 1, wherein the metal is aluminium, titanium or magnesium or their alloys.

4. The coating method according to claim 1, wherein the applied voltage and current density are respectively 150-680 Volts and 0.5-5.0 milliamperes per square millimeter ($mA/mm^2$).

5. The coating method according to claim 1, wherein the air-containing oxide coating has an oxide portion consisting of at least one of aluminum oxide, titanium oxide or magnesium oxide.

6. The coating method according to claim 1, wherein the air-containing oxide coating has air pockets in varying sizes ranging 0.1-10 microns in diameter.

7. The coating method according to claim 1, wherein the coating thickness is in the range of 15-150 microns.

8. The coating method according to claim 1, wherein the air-containing oxide coating and its metallic base have a thermal diffusivity of 5-50 square millimeter per second ($mm^2/s$).

9. The coating method according to claim 1, wherein the air-containing oxide coating and its metallic base have a thermal conductivity of 0.15-150 Walt per meter per Kelvin (W/m·K).

10. The coating method according to claim 1, wherein the air-containing oxide coating is deposited on cylinder bores, piston crowns, combustion chamber dome areas of cylinder heads, exhaust and intake ports of cylinder heads, supercharger and turbocharger parts, and parts of battery, electrical motor, pumps and actuators made of the said metal.

* * * * *